US007456724B2

(12) United States Patent
Mogi et al.

(10) Patent No.: US 7,456,724 B2
(45) Date of Patent: Nov. 25, 2008

(54) ELECTRICAL STEEL SHEET FOR LOW-NOISE TRANSFORMER AND LOW-NOISE TRANSFORMER

(75) Inventors: Hisashi Mogi, Futtsu (JP); Masahiro Fujikura, Futtsu (JP); Shuichi Yamazaki, Futtsu (JP); Masato Mizokami, Futtsu (JP); Masao Yabumoto, Futtsu (JP); Osamu Akisue, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 587 days.

(21) Appl. No.: 10/808,925

(22) Filed: Mar. 25, 2004

(65) Prior Publication Data

US 2004/0178872 A1 Sep. 16, 2004

Related U.S. Application Data

(62) Division of application No. 10/034,061, filed on Dec. 27, 2001, now abandoned.

(30) Foreign Application Priority Data

Dec. 28, 2000 (JP) ..... 2000-401447

(51) Int. Cl.
*H01F 27/24* (2006.01)

(52) U.S. Cl. ..... 336/219

(58) Field of Classification Search ..... 336/65, 336/83, 212, 219, 233–234
See application file for complete search history.

(56) References Cited

U.S. PATENT DOCUMENTS

| | | | | |
|---|---|---|---|---|
| 5,063,098 A | | 11/1991 | Niwa et al. | 428/78 |
| 5,143,790 A | * | 9/1992 | Sattinger | 428/457 |
| 5,188,698 A | | 2/1993 | Imai et al. | 156/500 |

FOREIGN PATENT DOCUMENTS

| | | |
|---|---|---|
| JP | H-5-251246 | 9/1993 |
| JP | H-7-85457 | 3/1995 |
| JP | H-7-305115 | 11/1995 |
| JP | H-8-45751 | 2/1996 |
| JP | H-8-111322 | 4/1996 |
| JP | H-8-250339 | 9/1996 |
| JP | 2000-82622 | 3/2000 |
| JP | 2000-124044 | 4/2000 |
| JP | 2001-93583 | 4/2000 |
| WO | WO 99/33156 | 7/1999 |

OTHER PUBLICATIONS

"Development of Orient Core Hi-B", OHM '72/2, Feb. 1972, pp. 1-7.
Patent Abstract of Japan, JP 08250339, Sep. 27, 1996.
Patent Abstracts of Japan, JP 62001879, Jan. 7, 1987.

* cited by examiner

*Primary Examiner*—Tuyen T. Nguyen
(74) *Attorney, Agent, or Firm*—Kenyon & Kenyon LLP

(57) ABSTRACT

The present invention provides an electrical steel sheet core for a low-noise transformer capable of effectively lowering noise by suppressing vibration perpendicular to the surfaces of the steel sheets and reducing vibration, and relates to an electrical steel sheet for a low-noise transformer characterized by randomly inserting viscoelastic layers with both viscosity and elasticity into the gaps of the steel sheet lamination layers, and a low-noise transformer formed by using said electrical steel sheet.

2 Claims, 3 Drawing Sheets

ELECTRICAL STEEL SHEET FOR LOW-NOISE TRANSFORMER AND LOW-NOISE TRANSFORMER

This application is a divisional application under 35 U.S.C. §120 and §121 of prior application Ser. No. 10/034,061 filed Dec. 27, 2001 now abandoned. The entire disclosure of prior application Ser. No. 10/034,061 is considered part of this divisional application and is hereby incorporated by reference.

BACKGROUND OF THE INVENTION

1. Field of the Invention

The present invention relates to an electrical steel sheet for a low-noise transformer, which lowers the vibration when the sheet is used for the core of a transformer or the like, and to a low-noise transformer.

2. Description of the Related Art

With respect to a magnetic material widely used in electrical and electronic apparatuses, the degree of a change in the length of the material when a magnetic field is imposed thereon (such degree of a change is called magnetostriction) is one of the important evaluation items in quality control since it causes transformer noise. In recent years, regulations against the noise of electrical apparatuses have been tightened with the increase in demands for better living environments. Because of this, research into the lowering of noise by reducing magnetostriction are being carried out intensively.

Among magnetic materials, as grain-oriented electrical steel sheets used for the cores of transformers, there is a method of reducing magnetostriction by decreasing closure domains. The closure domain cited here is a domain having magnetization oriented in a direction perpendicular to the direction where a magnetic field is imposed. Magnetostriction is generated when the magnetization moves toward a direction parallel to that of the magnetic field due to the imposed magnetic field. Therefore, the smaller the amount of closure domains is, the smaller the magnetostriction is. The following methods are known as major methods for reducing magnetostriction:

① A method of arranging the <001> directions of crystal grains in the direction of rolling and preventing the generation of closure domains which cause a change in their shape due to magnetization rotation (T. Nozawa et al, "Relationship Between Total Losses under Tensile Stress in 3 Percent Si—Fe Single Crystals and Their Orientations near (110) [001]," IEEE Trans. on Mag., Vol. MAG-14, No.4, 1978), ② A method of eliminating closure domains by releasing plastic strain (Japanese Unexamined Patent Publication No. H7-305115; "Development of Epoch-making Grain-Oriented Silicon Steel Sheet, Orient Core Hi-B"; OHM 1972.2), ③ A method of eliminating closure domains by imposing a film tension on a steel sheet (T. Nozawa et al, "Relationship between Total Losses under Tensile Stress in 3 Percent Si—Fe Single Crystals and Their Orientations near (110) [001]," IEEE Trans. on Mag., Vol. MAG-14, No.4, 1978).

On the other hand, noise can be lowered by the methods of suppressing the generation of vibration, besides the methods of reducing magnetostriction. The methods for lowering noise by suppressing the generation of vibration include, for example; a method of disposing an air space or a silicone rubber to cut off the propagation of vibration (Japanese Unexamined Patent Publication No. H5-251246), methods of lowering noise by disposing a vibration damping material and a sound absorbing material outside each core leg (Japanese Unexamined Patent Publication Nos. H8-45751, 2000-82622, and 2000-124044), a method of fixing the gap parts of a reactor by the use of an adhesive capable of suppressing vibration (Japanese Unexamined Patent Publication No. H8-111322), and a method of using an electrical steel sheet provided with an intermediate resin layer (Japanese Unexamined Patent Publication No. H8-250339).

The noise of electrical apparatuses have so far been lowered mainly by those methods of reducing magnetostriction or vibration.

SUMMARY OF THE INVENTION

Demands for further lowering the noises of electrical apparatuses are increasing and more sophisticated technologies are required to meet the demands. Research into lowering noise has so far been focused mainly on reducing magnetostriction by eliminating closure domains. However, when a magnetic field which changes with the passage of time is imposed on steel sheets incorporated into a transformer core, the expansion and contraction generated therein are changed into vibration perpendicular to the surfaces of the steel sheets because they are not necessarily flat. This vibration produces the waves of condensation and rarefaction in air and the waves spread out as sound. Until now, for lowering such vibration by reducing the magnetostriction of a steel sheet, techniques of sharpening the distribution of crystal orientations, releasing plastic strain, imposing a tension and the like, as mentioned above, have been established as prior arts. Apart from those, there is a measure of disposing a vibration proof structure that prevents vibration from being transmitted to the exterior. However, to cope with the demands for further noise reduction, another method to suppress the plane vibration of steel sheets that causes air particles to vibrate is required.

As a means to solve this problem, already proposed has been a core composed of electrical steel sheets having intermediate resin layers. However, the space factor of the core is low because the intermediate resin layers are placed in the core at the intervals of every two laminated steel sheets. Therefore, it is necessary to increase the area of the iron portions in the cross-section of the core.

The object of the present invention is to provide an electrical steel sheet for a low-noise transformer with lowered vibration and the low-noise transformer, which realize noise reduction effectively by finding conditions for suppressing vibration perpendicular to the surfaces of the steel sheet.

The gist of the present invention is as follows:

(1) An electrical steel sheet for a low-noise transformer, characterized by having a viscoelastic layer 30 μm or more in thickness on at least one of the surfaces of the steel sheet.

(2) An electrical steel sheet for a low-noise transformer according to the item (1), having an viscoelastic layer whose loss factor has one or more peaks at temperatures within the range from 20 to 200° C.

(3) A low-noise transformer formed by using an electrical steel sheet for a low-noise transformer according to the item (1) or (2).

(4) A low-noise transformer characterized in that the transformer core formed by laminating n pieces of electrical steel sheets has viscoelastic layers 30 μm or more in thickness placed at m gaps among the n−1 gaps of laminated layers, m satisfying the following formula:

$$3 \leqq (n-1)/m \leqq 30.$$

(5) A low-noise transformer characterized by inserting viscoelastic layers at random in the core formed by using an electrical steel sheet for a low-noise transformer according to item (1) or (2).

DESCRIPTION OF THE PREFERRED EMBODIMENT

As mentioned above, the current major methods have been focused on lowering in-plane vibration by reducing magnetostriction, or on employing a vibration proof structure that prevents vibration from being transmitted to the exterior. On the other hand, the inventors of the present invention focused on a research for more effectively realizing the noise reduction by reducing the in-plane vibration of steel sheets in a method of inserting viscoelastic layers with both viscosity and elasticity into the gaps of the steel sheet lamination layers in the core of a transformer. The embodiments of the present invention are hereunder explained based on experiment.

Figure 1:
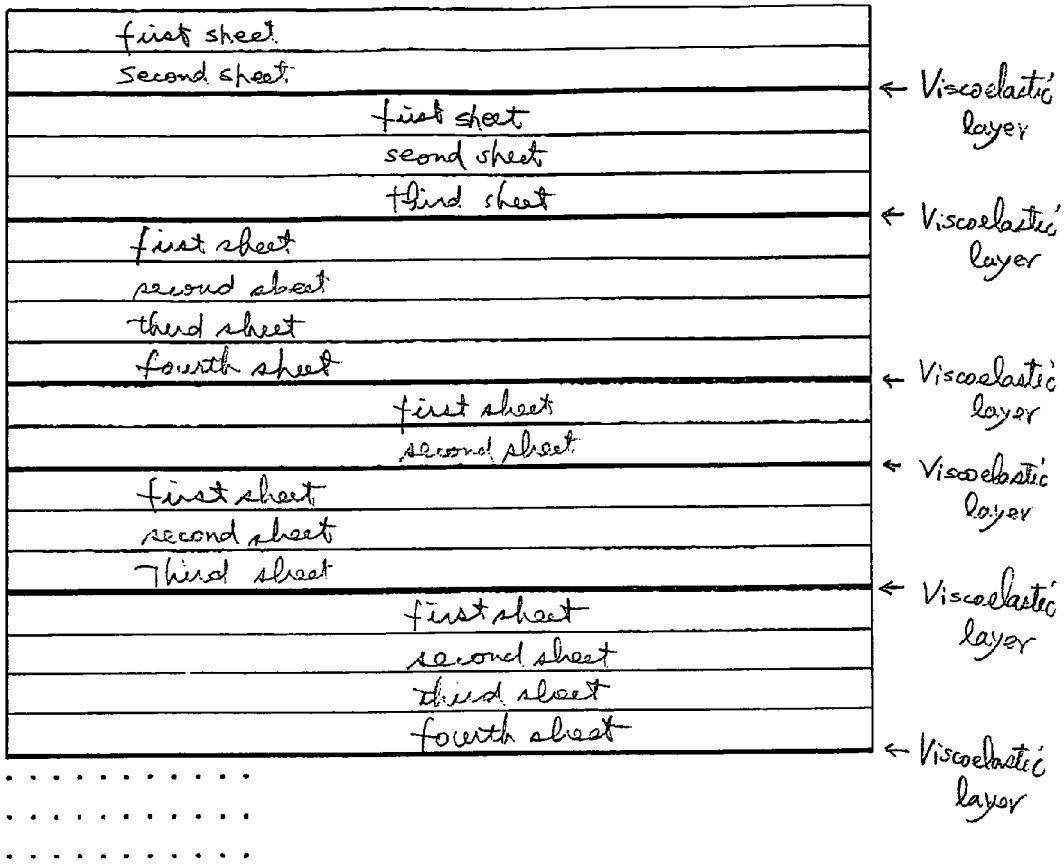
FIG. 1 is a schematic showing the dimensions of a transformer used for measuring noise.
Figure 2:
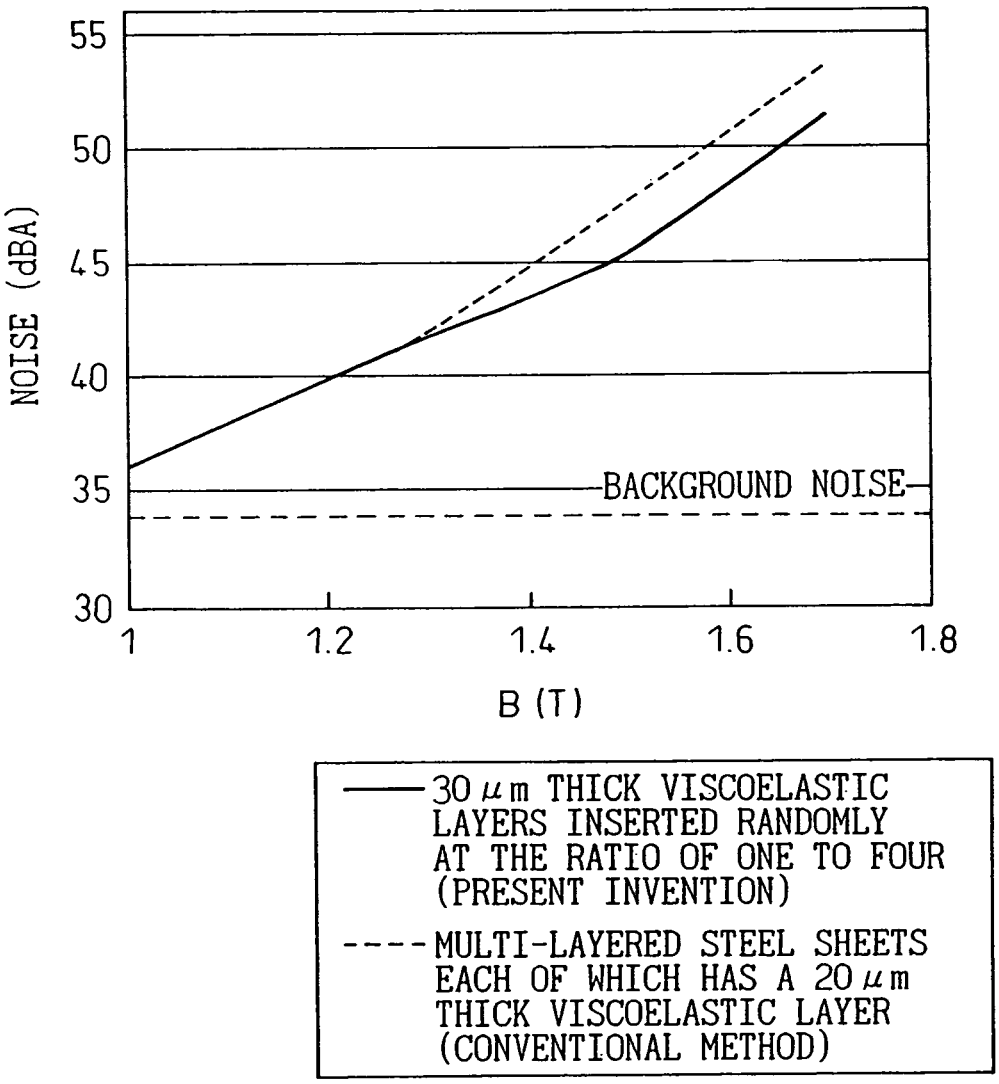
FIG. 2 is a graph showing the effects of viscoelastic layers on the noise of the transformer.

Small-sized transformers of 300 mm×180 mm×10 mm (FIG. 1) were manufactured and their noises were measured (FIG. 2). The noises were compared between two cores; a core made of multi-layered electrical steel sheets each of which had a viscoelastic layer 20 μm in thickness between every two electrical steel sheets (the total thickness of the viscoelastic layers being 0.42 mm) and the other core having viscoelastic layers 30 μm in each thickness inserted therein randomly at the ratio of one viscoelastic layer to four steel sheet layers so that the layers were not regularly arrayed (the total thickness of viscoelastic layers being 0.30 mm). As a result of this experiment, the core with the viscoelastic layers randomly inserted therein at the ratio of one to four was lower in noise even though the total thickness of the viscoelastic layers was thinner.

Exact reason for this effect is not clear, but the inventors assume that a larger thickness of each viscoelastic layer is more effective in absorbing vibration and the effect in this case is larger than that in the case where a greater number of thinner viscoelastic layers are dispersed in a core.

Apart from this, the resonance frequency of a core is determined by its weight when its material quality is given. When viscoelastic layers are inserted into a core at equal intervals, the core is divided into the steel sheet blocks of equal weight, and therefore the blocks have the same resonance frequency which causes a vibration to be amplified by resonance. On the contrary, when the intervals of viscoelastic layers are random, their resonance frequencies are different from each other and therefore a large vibration at a particular frequency is hardly generated, which the present inventors' assumption.

Figure 3:
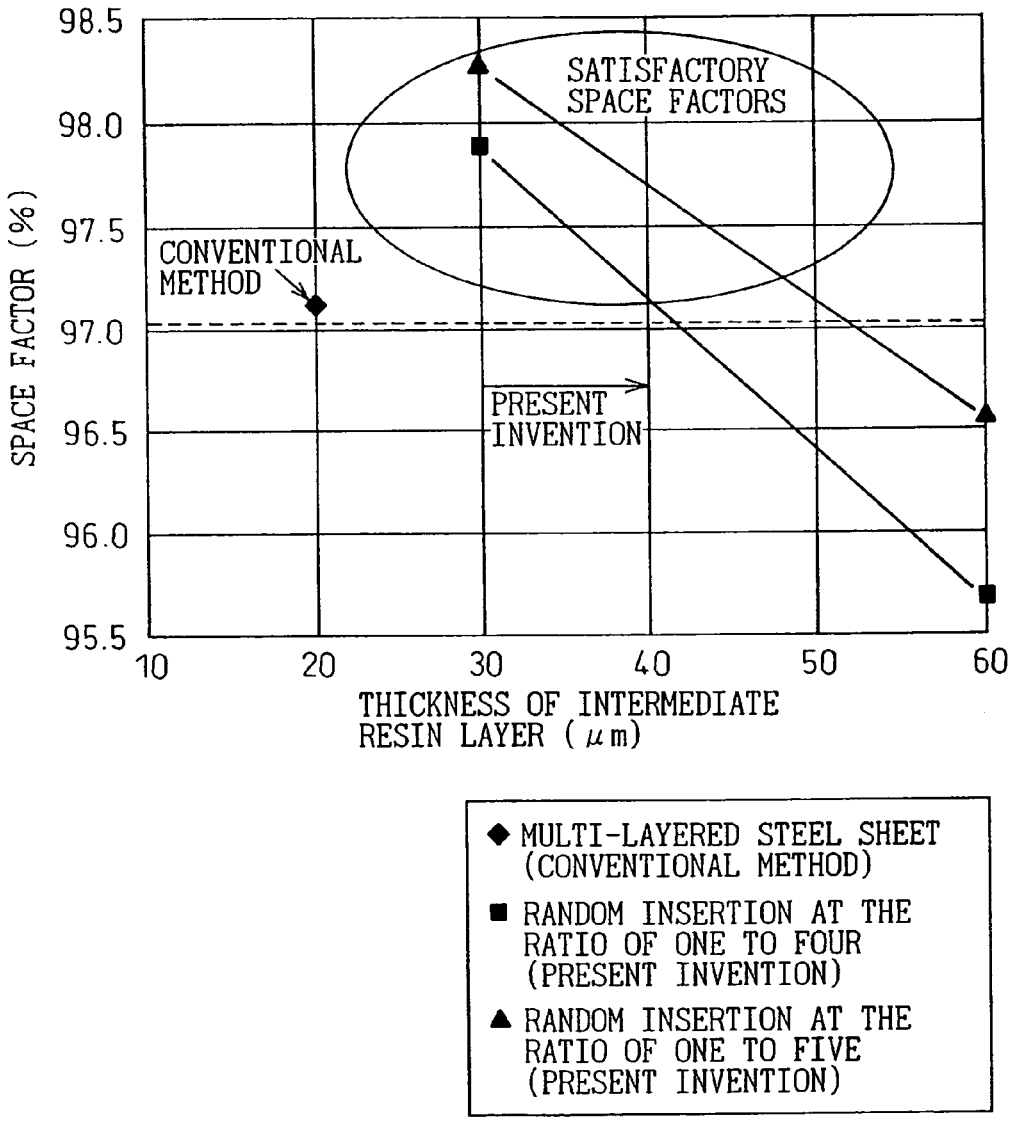
FIG. 3 is a graph showing the space factors of the electrical steel sheets.

Space factors obtained by these methods are shown in FIG. 3. The core having a greater number of viscoelastic layers dispersed therein according to a conventional method has a lower space factor than the laminated core according to the present invention because the core according to a conventional method has a greater number of viscoelastic layers even though the thickness of each of the viscoelastic layers is as small as 20 μm. According to the present invention, the absorption of vibration is improved by the thicker viscoelastic layers, and therefore not only can noise be lowered but also space factors can be increased.

From the above viewpoint, the present inventors have thought that the prior arts of merely reducing magnetostriction are insufficient to lower noises and it is also important to suppress in-plane vibration. The present inventors have found that the conditions required for suppressing plane vibration are satisfied by randomly inserting viscoelastic layers between steel sheets and the noise of electric apparatuses such as transformers can be effectively lowered by applying such electrical steel sheets thereto, and have attained the present invention.

Now the limit conditions in the present invention are explained hereunder.

A noise reduction effect intensifies as the thickness of a viscoelastic layer increases. According to the method disclosed in Japanese Examined Patent Publication No. H7-85457, vibration can be suppressed by inserting an impregnant in a laminated core of 6.5% Si. In this case, the thickness of the impregnant is estimated to be at most about 10 μm since the surface roughness Rmax of the laminated steel sheets is specified to be 3.5 μm or more and the core is vacuum-impregnated after it is tightened. On the other hand, in case of the present invention, viscoelastic layers at least 30 μm or more, preferably 40 to 60 μm, in thickness are used in order to intensify the effect of suppressing vibration.

In case of general transformer cores, the temperature range during their operation is 20 to 200° C. and therefore it is preferable that the peak of the loss factor of the viscoelastic body lies in this temperature range. At what temperature within this range the loss factor should have a peak may be determined according to the environment where the core is used. It is already known that polyisobutylene has a peak of its loss factor at 0° C., polyester at 100° C., and nitrile rubber at 20° C.

With respect to a core of the present invention, the expression $(n-1)/m$ is determined to be 3 or more, because the space factor remarkably decreases if viscoelastic layers are inserted in the core at the ratio of one or more viscoelastic layers to three steel sheet layers. At the same time, the $(n-1)/m$ is determined to be 30 or less, because the absorption of vibration weakens if viscoelastic layers are inserted in the core at the ratio of one to 30.

The reason why viscoelastic layers are inserted between steel sheets at unequal random layer intervals is to disperse the resonance frequencies and to avoid the amplification of vibration caused by the resonance.

EXAMPLE 1

The following laminated cores A, B, C and D were manufactured using grain-oriented electrical steel sheets 0.23 mm in thickness produced by a usual method: core A with nothing inserted therein, core B with polyester resin inserted therein at the ratio of one resin layer to 10 steel sheet layers and at unequal layer intervals, core C with olefinic film resin inserted therein at the ratio of one to 10 and at unequal layer intervals, and core D with polyisobutylene resin inserted in all the layer gaps between steel sheets. 500 kVA three-phase transformers were assembled using the cores A, B, C and D respectively and then the noise was measured when the cores were magnetized in 1.6 T at 50 Hz. The thickness of each resin layer was 20 μm for the core D and 50 μm for the others, and the total thickness of the laminated layers of each transformer was 50 mm. The results of the measurement are shown in Table 1.

The transformer cores B and C manufactured using the materials satisfying the conditions of the present invention had lower noise.

TABLE 1

| Sample number | Noise | Remarks |
|---|---|---|
| A | 50.6 db(A) | Prior art |
| B | 44.4 db(A) | Present invention |
| C | 42.7 db(A) | Present invention |
| D | 48.9 db(A) | Prior art |

(B, C: 50 μm resin layers
D: 20 μm resin layers inserted in all layer gaps)

EXAMPLE 2

The following laminated cores E, F, G, H and I were manufactured using grain-oriented electrical steel sheets 0.27 mm in thickness produced by a usual method: core E with nothing inserted therein, core F with olefinic film resin inserted therein at the ratio of one resin layer to 10 steel sheet layers, core G with the same resin inserted therein at the ratio of one to 20, core H with the same resin inserted therein at the ratio of one to 30, and core I with the same resin inserted therein at the ratio of one to 40. 500 kVA three-phase transformers were assembled using the cores E, F, G, H and I respectively and then the noise was measured when the cores were magnetized in 1.4 T at 50 Hz. The thickness of each resin layer was 50 μm and the total thickness of the laminated layers of each transformer was 50 mm. The results of the measurement are shown in Table 2. The core G with the resin layers inserted therein at the ratio of one to 20 exhibited the minimum noise.

As described above, the transformer cores F, G and H manufactured using the materials satisfying the conditions of the present invention had lower noise.

TABLE 2

| Sample number | Noise | Remarks |
|---|---|---|
| E | 50.6 DB(A) | Prior art |
| F | 42.8 DB(A) | Present invention |
| G | 41.6 DB(A) | Present invention |
| H | 45.9 DB(A) | Present invention |
| I | 48.4 DB(A) | Prior art |

EXAMPLE 3

The following laminated cores J, K, L and M were manufactured using grain-oriented electrical steel sheets 0.27 mm in thickness produced by a usual method: core J with nothing inserted therein, core K with olefinic film resin inserted therein at the ratio of one resin layer to 10 steel sheet layers, core L with the same number of resin layers as core K inserted therein at the ratio of one to three in such a manner as to be concentrated in the middle part of the core, and core M with the same number of resin layers as core K inserted therein at the ratio of one to three in such a manner as to be concentrated in the surface parts of the core. 500 kVA three-phase transformers were assembled using the cores J, K, L and M respectively and then the noise was measured when the cores were magnetized in 1.4 T at 50 Hz. The thickness of each resin layer was 50 μm and the total thickness of the laminated layers of each transformer was 50 mm. The results of the measurement are shown in Table 3.

As described above, the transformer cores K and L manufactured using the materials satisfying the conditions of the present invention had lower noise.

TABLE 3

| Sample number | Noise | Remarks |
|---|---|---|
| J | 50.6 dB(A) | Prior art |
| K | 42.1 dB(A) | Present invention |
| L | 41.0 dB(A) | Present invention |
| M | 44.1 dB(A) | Present invention |

As explained above, the present invention can provide an electrical steel sheet for a low-noise transformer and the transformer, which suppress vibration perpendicular to the surfaces of the steel sheet, effectively realize the noise reduction and lower vibration, and thus can achieve the noise reduction of electrical apparatuses. Therefore the present invention can offer an exceedingly great industrial benefit.

The invention claimed is:

1. A low-noise transformer characterized in that the transformer core formed by laminating n pieces of electrical steel sheets has viscoelastic layers 30 μm or more in thickness inserted at m gaps among the n-1 gaps of laminated layers, wherein the number of laminated layers between the gaps wherein said viscoelastic layers are inserted are unequal, m satisfying the following formula:

$$3 \leqq (n-1)/m \leqq 30.$$

2. A low-noise transformer according to claim 1 wherein said viscoelastic layer has a loss factor with one or more peaks at temperatures within a range from 20 to 200° C.

* * * * *